United States Patent [19]

Lownds et al.

[11] 4,183,775

[45] Jan. 15, 1980

[54] EXPLOSIVE CONTAINING POLYVINYL CHLORIDE AND ALUMINUM AS SENSITIZER

[75] Inventors: Charles M. Lownds, Johannesburg; Nigel A. Healy, Edenvale, both of South Africa

[73] Assignee: AECI Limited, Johannesburg, South Africa

[21] Appl. No.: 950,143

[22] Filed: Oct. 10, 1978

[30] Foreign Application Priority Data

Oct. 14, 1977 [ZA] South Africa ..... 77/6117

[51] Int. Cl.[2] ..... C06B 45/02

[52] U.S. Cl. ..... 149/21; 149/44; 149/115; 149/43

[58] Field of Search ..... 149/2, 21, 44, 115

[56] References Cited

U.S. PATENT DOCUMENTS

| | | | |
|---|---|---|---|
| 3,107,186 | 10/1963 | Scurlock et al. | 149/44 X |
| 3,761,329 | 9/1973 | Zilcosky | 149/44 X |

*Primary Examiner*—Stephen J. Lechert, Jr.

*Attorney, Agent, or Firm*—Cushman, Darby & Cushman

[57] ABSTRACT

A slurry explosive composition comprising of inorganic salt, fuel, and a liquid solvent, disperser or carrier for the salt, the composition also containing, as sensitizer a synergistic mixture of polyvinyl chloride and flake aluminium.

7 Claims, No Drawings

EXPLOSIVE CONTAINING POLYVINYL CHLORIDE AND ALUMINUM AS SENSITIZER

SLURRY EXPLOSIVE COMPOSITION

This invention relates to explosive blasting compositions. More particularly, it relates to explosive compositions of the type known generally in the art as slurry explosive compositions or slurried blasting agents. The explosive component in these slurry compositions is an inorganic oxidising salt, which usually is ammonium nitrate or sodium nitrate or a mixture of these two salts, but it may also comprise ammonium perchlorate, potassium nitrate, calcium nitrate, barium nitrate, potassium perchlorate, calcium perchlorate or barium perchlorate.

In addition to the oxidising salt, slurry explosives comprise fuel and a liquid solvent, disperser or carrier for the said salt. Although the term 'slurry' is applied to such compositions the consistency may range from pourable to highly viscous extrudable gels.

The liquid content of slurry explosive is sufficient to maintain a continuous liquid phase which facilitates loading into boreholes or into paper or plastics containers to form blasting cartridges. The liquid phase may vary widely in its chemical constitution consistency and explosive sensitivity. Thus, in aqueous slurries, the liquid phase may consist mainly of an aqueous solution of inorganic oxidising salt but, non-aqueous slurry compositions are known wherein the liquid phase comprises a liquid chemical compound, which acts as fuel to contribute energy to the composition. Thickening agents, such as guar gum, dissolved in the liquid phase have been extensively used to increase the viscosity of slurry explosives, in order to prevent segregation of the ingredients and to prevent deterioration in wet conditions. Further improvements in the homogeneity and storage properties have been obtained by crosslinking the thickening agents with crosslinking agents, for example, potassium and sodium dichromates or potassium pyroantimonates. It is also common practice to improve the sensitivity of slurry explosive compositions by introducing voids to provide 'hot-spots' which are well known to facilitate initiation and propagation of detonation. Such voids may be introduced by mechanical mixing, preferably using a foaming surfactant in the composition, or by including gas filled spheres, or gas generating substances in the composition.

Fuel is included in the slurry explosive composition to combine with the oxygen from the oxidising salt and enhance the power and sensitivity of the composition. A wide variety of fuel materials have been used including coal, carbon black, sulphur, sugar, molasses, starches, metal powder and various alcohols. Whilst all fuels have a sensitising effect, some fuels have been found to be especially effective in this respect and have been widely used usually in combination with other cheaper fuel to provide compositions which require less powerful, and therefore less expensive primers for their initiation. Such sensitisers include solid materials such as finely divided metal powders and self-explosive materials such as trinitrotoluene and pentaerythritol tetranitrate.

Aluminium in various forms has been a preferred component for general use in sensitising explosive slurry compositions but aluminium is a costly constituent relative to the cost of other constituents, particularly when used in any substantial quantities. Its elimination from or a reduction of its content in the various formulae of explosive slurry compositions has long been desired but has proved difficult to achieve because the consequent reduction in sensitivity could not be compensated by any convenient alternative constituent.

It has been known for many years to employ aluminium in a finely divided or flake form which has been found to be a particularly effective sensitiser. This material, which in the usual form is termed paint-fine aluminium, is coated with stearic acid to prevent the exothermic reaction with water which can lead to a dangerous situation for the handling and storage of the explosive. The stearic acid coating of aluminium particles disclosed in the prior art renders the surface of the aluminium lyophobic. When paint-fine aluminium is incorporated into a slurry explosive composition and the explosive is aerated by mechanical mixing, or otherwise, it is believed that gas bubbles adhere to the surface of the aluminium, forming a buffer between the aluminium surface and the aqueous phase of the explosive which enhances the sensitivity of the explosive to initiation by a detonator. On the basis of the 'hot-spot' theory of initiation, the enhancement of sensitivity is believed to be due to the proximity of gas bubbles to the aluminium surface. When a shockwave produced by a detonator travels through slurry composition and adiabatically compresses these gas bubbles at the aluminium surface, the consequent rapid increase in temperature produces 'hot-spots' having sufficiently high temperature to start a rapid combustion of the oxidiser solution and adjacent aluminium particle. If a sufficient number of 'hot-spots' are generated simultaneously a self-sustaining detonation wave is produced and complete detonation of the composition ensues.

It is obvious that any method of using paint-fine aluminium more effectively whereby its content in slurry explosives could be reduced, would be highly desirable in order to reduce the cost of the explosive composition. We have now discovered that particulate polyvinyl chloride (PVC) exhibits a significant synergistic sensitising action with low levels of paint-fine aluminium in slurry explosive compositions, which synergistic sensitising action is effective when the slurry explosive is initiated in small diameters. Thus a formulation containing 1.5% w/w paint-fine aluminium as a sensitiser may be initiated by 0.36 g PETN. A similar formulation which contains, in addition to the aluminium, 5.5% w/w polyvinyl chloride may be initiated by 0.045 g PETN, although the polyvinyl chloride displays little, if any, sensitising effect in the absence of paint-fine aluminium.

According to the present invention a slurry explosive composition includes particulate polyvinyl chloride as an essential component with particulate paint-fine aluminium. It is likely that the synergistic sensitising action of polyvinyl chloride and paint-fine aluminium is complex and due to several factors. It is a lyophobic powder which may enable gas bubbles generated in a slurry explosive to adhere to its surface in a similar manner to that of paint-fine aluminium. Additionally, the reaction between aluminium and polyvinyl chloride is exothermic which is likely to improve the sensitivity of the system. However the mechanism of the synergistic sensitising action has not yet been fully elucidated.

A very considerable reduction in the raw materials costs of slurry explosives is achieved by significantly reducing the level of paint-fine aluminium normally used. Additionally, polyvinyl chloride is much cheaper than any grade of paint-fine aluminium and is also commercially more freely available.

The polyvinyl chloride is conveniently present in amounts in the range from 0.5% to 10%, preferably in in the range from 2% to 6% by weight of the slurry explosive composition. It is preferably in the form of a finely flaked powder having a particle size such that not more than 0.1% w/w is retained in a 250 micron sieve (BSS 60).

The explosive composition preferably contains 1 to 10 parts by weight of polyvinyl chloride for each part of paint-fine aluminium and the paint-fine aluminium content is conveniently in the range from 1.0 to 10.0% by weight of the composition.

The invention is further illustrated by the following examples where all parts and percentages are by weight. Example 2 is a composition in accordance with the invention and Examples 1 and 3 are included for comparison.

EXAMPLES

In the Examples the polyvinyl chloride was a powder having particle size such that not more than 0.1% w/w was retained on a 250 micron sieve (BSS 60). The paint-fine aluminium was flake aluminium having a water covering capacity of not less than 6,000 $cm^2/g$ and coated with 0.5% of stearic acid. The aluminium particle size was such that not more than 5% w/w was retained on a 150 micron sieve (BSS 100) and 40 to 80% w/w passed a 45 micron sieve (BSS 350).

In each Example a solution was first prepared at 55° C. which contained ingredients marked with an asterisk. The gum was allowed to hydrate at 55° C. for four hours. To the solution was added sodium nitrate, oathusk meal and atomised aluminium. After thorough mixing, a slurry of tapioca flour in water was added and mixed. Sodium nitrite solution (1:2 sodium nitrite:water) was then added to initiate chemical gassing of the system. An aqueous slurry of potassium pyroantimonate was added to begin crosslinking and gelling of the formulation. Finally, a mixture of polyvinyl chloride and paint-fine aluminium was incorporated into the mix and the material was cartridged and left to gas to the desired density. Details of the composition and initiation results are given in the accompanying Table.

In the minimum initiator test a 2.5 cm diameter cartridge was initiated by a detonator containing a priming charge consisting of 150 mg of 4/1 lead azide/lead styphnate mixture and a base charge consisting of the indicated weight of PETN.

| Examples | (1) | (2) | (3) |
|---|---|---|---|
| Composition (%) | | | |
| Urea* | 4.5 | 4.5 | 4.5 |
| Ammonium nitrate* | 40.1 | 40.1 | 40.1 |
| Sodium nitrate*+ | 26,085 | 26,085 | 26,085 |
| Atomised aluminium | 4.0 | 4.0 | 4.0 |
| Oathusk meal | 5.5 | — | — |
| Tapioca flour | 2.0 | 2.0 | 2.0 |
| Thiourea* | 0.1 | 0.1 | 0.1 |
| Water* | 14.0 | 14.0 | 14.0 |
| Sodium nitrate solution | 0.15 | 0.15 | 0.15 |
| Guar gum* | 0.6 | 0.6 | 0.6 |
| Glycol* | 1.3 | 1.3 | 1.3 |
| Pot. pyroantimonate slurry | 0.165 | 0.165 | 0.165 |
| Paint-fine aluminium | 1.5 | 1.5 | — |
| Polyvinyl chloride | — | 5.5 | 7.0 |
| Properties | | | |
| Density $Mg/m^3$ | 1.12 | 1.12 | 1.12 |
| Temperature | 17° | 17° | 17° |
| Minimum initiator (mg PETN) | | | |
| Fired | 360 | 45 | — |
| Failed | 180 | 22 | 2500 |

+ 10 of the 26,085% sodium nitrate is used in the solution. The rest is added as a dry ingredient The Examples demonstrate that PVC alone is not an effective sensitiser. However, addition of PVC to a slurry explosive containing paint-fine aluminium gives a marked increase in sensitivity. PVC is therefore a valuable ingredient in slurry explosives containing paint-fine aluminium, enabling a reduction in the amount of the aluminium sensitiser required to produce a specific degree of sensitivity.

What we claim is:

1. A slurry explosive composition comprising at least one inorganic salt, a liquid solvent, disperser or carrier for said salt, and particulate fuel comprising flake aluminium and polyvinyl chloride, said flake aluminium and polyvinyl chloride having a synergistic sensitising action.

2. A slurry explosive composition as claimed in claim 1 comprising 0.5 to 10% by weight of polyvinyl chloride.

3. A slurry explosive composition as claimed in claim 1 comprising 2 to 6% by weight of polyvinyl chloride.

4. A composition as claimed in claim 1 comprising polyvinyl chloride in flake form.

5. A composition as claimed in claim 1 wherein the polyvinyl chloride consists of particles of which not more than 0.1% w/w is retained on a 250 micron sieve (BSS 60).

6. A composition as claimed in claim 1 containing 1 to 10 parts by weight of polyvinyl chloride for each part of flake aluminium.

7. A slurry explosive composition as claimed in claim 1 containing 0.1 to 6% w/w of flake aluminium.

* * * * *